United States Patent [19]

Carroll et al.

[11] Patent Number: 5,061,610

[45] Date of Patent: Oct. 29, 1991

[54] REDUCTION OF OPTICAL BRIGHTENER MIGRATION IN POLYOLEFIN COATED PAPER BASES

[75] Inventors: John F. Carroll, Rochester; David A. Griggs, Hilton; William A. Mruk, Rochester, all of N.Y.

[73] Assignee: Eastman Kodak Company, Rochester, N.Y.

[21] Appl. No.: 601,097

[22] Filed: Oct. 22, 1990

[51] Int. Cl.[5] ..... G03C 1/76

[52] U.S. Cl. ..... 430/532; 430/271; 430/501; 430/523; 430/538

[58] Field of Search ..... 430/532, 538, 500, 501, 430/523, 271

[56] References Cited

U.S. PATENT DOCUMENTS

| | | | |
|---|---|---|---|
| 3,411,908 | 11/1968 | Crawford et al. | 430/532 |
| 3,582,338 | 6/1971 | Yost et al. | 96/87 |
| 3,607,345 | 4/1968 | Thomas et al. | 117/34 |
| 3,669,709 | 6/1972 | Kasugal et al. | 117/34 |
| 3,853,585 | 12/1974 | Tatsuta et al. | 117/34 |
| 4,181,528 | 1/1980 | Work et al. | 430/537 |
| 4,188,220 | 2/1980 | Kasugai et al. | 430/538 |
| 4,476,153 | 10/1984 | Kiritani et al. | 430/532 |
| 4,794,071 | 12/1988 | Tomko et al. | 430/538 |
| 4,859,539 | 8/1989 | Tomko et al. | 428/512 |
| 4,859,577 | 8/1989 | Tamagawa et al. | 430/538 |
| 4,870,001 | 9/1989 | Ashida et al. | 430/538 |

FOREIGN PATENT DOCUMENTS 214850 12/1984 Japan .

*Primary Examiner*—Jack P. Brammer
*Attorney, Agent, or Firm*—Robert A. Gerlach

[57] ABSTRACT

In the preparation of a light sensitive photographic paper wherein the paper support contains a polyolefin coating the polyolefin is subjeced to two corona discahrge treatments, the first to prevent optical brightener from exuding from the polyolefin upon storage and the second after storage and before coating the next adjacent layer unto the polyolefin surface.

4 Claims, No Drawings

REDUCTION OF OPTICAL BRIGHTENER MIGRATION IN POLYOLEFIN COATED PAPER BASES

BACKGROUND OF THE INVENTION

1. Field of the Invention

This invention relates to photographic supports and elements, and more particularly, to photographic supports and elements comprising a paper base material having thereon a polyolefin coating containing a white pigment and an optical brightener.

2. Background of the Invention

A valuable class of photographic supports and elements comprises a paper base material having thereon a polyolefin coating containing a white pigment and an optical brightener. Such supports are particularly useful in the preparation of photographic elements such as color prints because they exhibit good brightness and excellent dimensional stability and are highly resistant to the action of aqueous acid and alkaline photographic processing solutions. The polyolefin coating provides a very smooth surface which is desirable when thin layers, such as silver halide emulsion layers, are to be coated thereover, U.S. Pat. No. 3,411,908 describes such a support which has achieved widespread commercial acceptance.

The purpose of the optical brightener is to make the white areas of the support appear even brighter. The optical brightener fluoresces upon irradiation with ultraviolet (UV) light, emitting visible light, usually bluish in hue, thus enhancing the brightness of the support. Optical brighteners for use in photographic print materials must absorb UV light, especially in the region from 360 to 420 nm, and reemit such light so as to enhance the brightness of the print, and have the desired brightening power. The optical brightener must also be stable to the temperatures, as high as 310° to 330° C., used in incorporating it into the polyolefin and in extruding the polyolefin onto the paper base material.

A problem that has developed in employing optical brightening agents in the polyolefin layer for photographic elements is that optical brightening agents have a tendency to migrate toward the surface of the polyolefin and exude from the surface to form a film on the surface of the polyolefin. Such exudation not only gives rise to a nonuniform brightness of the reflection surface of the support, but also readily transfers to any other surface contacted with that surface. For example, optical brightener transferred nonuniformly to the backside of the adjacent layer of support when wound in roll form can adversely affect subsequent coating and finishing operation and, in consequence, the quality and performance of the final photographic element.

DESCRIPTION OF THE RELATED ART

U.S. Pat. Nos. 4,794,071 and 4,859,539 relate to a photographic support having a paper base with polyolefin coatings contained thereon wherein the polyolefin coatings have incorporated therein a mixture of certain optical brightening agents which do not exude from the polyolefin layer.

It has also been heretofore known to treat the surface of the polyolefin layer of a photographic paper support prior to the application of the next layer to be applied thereto in order to improve the adhesion of the next adjacent layer to the polyolefin surface. Japanese Patent Publication No. 214,850/59 mentions the improved adhesion by applying a corona discharge treatment to a polyethylene surface of a paper support and also indicates that the adhesion is improved if the corona discharge treatment is supplied directly before the coating, however, after the passage of time the adhesive power is usually reduced. No suggestion is made with regard to the prevention of optical brightener from migrating to the surface of the polyolefin layer.

U.S. Pat. No. 3,853,585 also recognizes the drawback that good adhesion is obtained when the photographic emulsion is coated on the polyethylene surface immediately after the corona discharge but that the improved adhesion gradually decreases with time and finally disappears. This patent teaches that the improved adhesion characteristic will not decrease or disappear even after storage if prior to the corona discharge treatment the surface of the polyethylene is roughened. No suggestion is made with regard to the prevention of optical brightener from migrating to the surface of the polyolefin layer.

U.S Pat. No. 3,669,709 suggests that an intermediate coating be applied between the polyethylene surface and the light-sensitive emulsion layer and that this intermediate layer be treated with corona discharge prior to the application of the light-sensitive layer. Again, this reference does not deal with the problem of migrating optical brightener in the polyolefin layer.

U.S. Pat. No. 3,607,345 suggest that the adverse effect of the corona activated polymeric supports upon the light-sensitive emulsions can be overcome by treating the polymer surfaces with corona discharge which activates the surface sufficiently to affect adhesion of the emulsion layers, at some time later, e.g., more than 30 minutes later, when the adverse effect of the activated surface has been dissipated but before substantial decrease in emulsion adhesion has taken place, coating the emulsion onto the activated polymer surface.

U.S. Pat. No. 3,582,338 recognizes the problem of dye mottle and indicates that delay is undesirable and solves the problem by spectrally sensitizing with a specific type of silver halide emulsion containing a specific cationic dye and applying this layer immediately after the corona discharge treatment.

SUMMARY OF THE INVENTION

The invention provides a method of making a light-sensitive photographic paper by coating a paper support with a layer of polyolefin polymer containing an optical brightening agent, subjecting the free surface of the polyolefin layer to a corona discharge immediately after the polyolefin layer is coated on the paper support to prevent the exudation of the optical brightening agent from the surface of the polyolefin layer and subjecting the surface of the polyolefin layer to a second corona discharge immediately prior to coating the free surface of the polyolefin layer with light-sensitive emulsion layer. It has been found that the first corona discharge treatment will prevent the exudation or blooming of the optical brightener to the surface of the polyolefin layer during the interim storage period between the coating of the polyolefin layer and the subsequent application of the various layers to convert the polyolefin coated paper support into a light-sensitive element. While this first corona discharge treatment will prevent the exudation of the optical brightening agent to the surface of the polyolefin layer, the adhesive nature of the polyolefin surface brought about by the corona discharge treatment will be lost over a period of time. Therefore, a second corona discharge treatment is required immediately prior to the application of subsequent layers to the polyolefin surface in order to restore the adhesive nature thereof.

DESCRIPTION OF THE PREFERRED EMBODIMENTS

Thus, the invention contemplates a method of making a light-sensitive photographic paper comprising the steps of coating a paper support with a polyolefin polymer containing an optical brightening agent, rolling the polyolefin coated support upon itself and storing, unrolling the stored support, corona discharge treating the polyolefin surface to increase the adhesive nature thereof, and applying at least one light-sensitive emulsion layer on the polyolefin surface wherein the improvement includes an additional corona discharge treatment of the polyolefin surface shortly after coating the polyolefin layer on the paper support and prior to the rolling step to inhibit the optical brightening agent from exuding from the polyolefin layer.

The photographic light-sensitive element prepared by the process of this invention comprises a paper base material having thereon a polyolefin coating containing an optical brightener. In a preferred embodiment, the polyolefin coating also contains a white pigment.

The polyolefin can be any coatable polyolefin material known in the photographic art. Representative of these materials are polyethylene, polypropylene, polystyrene, polybutylene and copolymers thereof. Polyethylene of low, medium or high density is preferred. The polyolefin can be copolymerized with one or more copolymers including polyesters, such as, polyethylene terephthalate, polysulfones, polyurethanes, polyvinyls, polycarbonates, cellulose esters, such as cellulose acetate and cellulose propionate, and polyacrylates. Specific examples of copolymerizable monomers include vinyl stearate, vinyl acetate, acrylic acid, methylacrylate, ethylacrylate, acrylamide, methacrylic acid, methylmethacrylate, ethylmethacrylate, methacrylamide, butadiene, isoprene, and vinyl chloride. Preferred polyolefins are film forming and adhesive to paper. Polyethylene having a density in the range of from about 0.91 grams/cm to about 0.98 grams/cm is particularly preferred.

Any suitable optical brightener may be employed in the polyolefin layer including those described in Research Disclosure Issue No. 308, December 1989, Publication 308119, Paragraph V, Page 998 (incorporated wholly herein by reference). The optical brightener is used in the polyolefin layer in an amount effective to brighten the reflectivity of the layer. The problem of exudation of the optical brightener from the polyolefin layer is of course more serious as the concentration of the optical brightener is increased. Optical brighteners are generally employed in the polyolefin layer in an amount of from about 0.001 to about 0.25 percent by weight based on the total weight of the polyolefin coating, including any white pigment present. Generally, excellent brightening is achieved by employing from about 0.01 to about 0.1 percent by weight. The corona discharge treatment of the polyolefin surface in accordance with this invention prevents the exudation of the optical brightener even at this high concentration.

Any suitable white pigment may be incorporated in the polyolefin layer, such as, for example, titanium dioxide, zinc oxide, zinc sulfide, zirconium dioxide, white lead, lead sulfate, lead chloride, lead aluminate, lead phthalate, antimony trioxide, white bismuth, tin oxide, white manganese, white tungsten, and combinations thereof. The pigment is used in any form that is conveniently dispersed within the polyolefin. The preferred pigment is titanium dioxide and the preferred titanium dioxide is the anatase crystalline form. Preferably, the white pigment should be employed in the range of from about 3 to about 35 percent by weight, preferably from about 5 to about 25 percent by weight, based on the total weight of the polyolefin coating. Anatase titanium dioxide at from about 5 to about 20 percent is most preferred.

In addition to the brightener mixture and the white pigment, the polyolefin coating can contain, if desired, a variety of additives including antioxidants such as 4,4'-butylidene-bis(6-tert-butyl-meta-cresol), di-lauryl-3,3'-thiodipropionate, N-butylated-p-aminophenol, 2,6-di-tert-butyl-p-cresol, 2,2-di-tert-butyl-4-methylphenol, N,N-disalicylidene-1,2-diaminopropane, tetra(2,4-tert-butylphenyl)-4,4'-diphenyl diphosphonite, octadecyl 3-(3',5'-di-tert-butyl-4'-hydroxyphenyl propionate), combinations of the above, and the like; heat stabilizers, such as higher aliphatic acid metal salts such as magnesium stearate, calcium stearate, zinc stearate, aluminum stearate, calcium palmitate, sodium palmitate, zirconium octylate, sodium laurate, and salts of benzoic acid such as sodium benzoate, calcium benzoate, magnesium benzoate and zinc benzoate; additional optical brightener; antistatic agents; dispersing agents; coating aids; slip agents; lubricants; dyes; and the like, as is well known to those skilled in the art. Additionally, emulsion side resins can contain one or more pigments, such as the blue, violet or magenta pigments described in U.S. Pat. No. 3,501,298, or pigments such as barium sulfate, colloidal silica, calcium carbonate and the like.

The paper base material employed in accordance with the invention can be any paper base material which has heretofore been considered useful for a photographic support. The weight and thickness of the support can be varied depending on the intended use. A preferred weight range is from about 20 g/m$^2$ to about 500 g/m$^2$. Preferred thicknesses (those corresponding to commercial grade photographic paper) are from about 20 $\mu$m to about 500 $\mu$m. It is preferred to use a paper base material calendered to a smooth surface. The paper base material can be made from any suitable paper stock preferably comprising hard or softwood. Either bleached or unbleached pulp can be utilized as desired. The paper base material can also be prepared from partially esterified cellulose fibers or from a blend of wood cellulose and a suitable synthetic fiber such as a blend of wood cellulose and polyethylene fiber.

As is known to those skilled in the art, the paper base material can contain, if desired, agents to increase the strength of the paper such as wet strength resins, e.g., the amino-aldehyde or polyamide-epichlorohydrin resins, and dry strength agents, e.g., starches, including both ordinary starch and cationic starch, or polyacrylamide resins. In a preferred embodiment of this invention, the amino-aldehyde, polyamide-epichlorohydrin and polyacrylamide resins are used in combination as described in U.S. Pat. No. 3,592,731. Other conventional additives include water soluble gums, e.g., cellulose ethers such as carboxymethyl cellulose, sizing agents, e.g., alkyl ketene dimers, sodium stearate which is precipitated onto the pulp fibers with a polyvalent metal salt such as alum, aluminum chloride or aluminum sulfate; fluorescing agents; antistatic agents; fillers, including clays or pigments such as titanium dioxide; dyes; etc.

The coating of the paper base material with the polyolefin preferably is by extrusion from a hot melt as is known in the art The paper base material preferably is treated with corona discharge to obtain good adhesion before the polyolefin coating is extruded thereon, as described in U.S. Pat. No. 3,411,908. The invention can be practiced within a wide range of extrusion temperatures, e.g., 150°-350° C., and speeds, e.g., about 60 m/min. to 460 m/min., depending on the particular intended application of the support. For many applications, preferred extrusion temperatures are about 310°-330° C. Under these conditions, the aforedescribed polyolefin coating, over which the silver halide emulsion is applied, is coated onto the paper base material in a coverage of about 1 to 100 g/gm$^2$, at a uniform thickness ranging from about 1 to 100 $\mu$m. About the same coverage of clear polyethylene coating preferably is applied to the side of the paper base material opposite to the pigmented polyolefin coating. As such, the polyolefin coatings are particularly effective in preventing acid and alkaline photographic processing solutions from penetrating to the paper base.

As noted, photographic elements in accordance with this invention comprise the above described optically brightened photographic support and at least one silver halide emulsion layer. Any of the known silver halide emulsion layers, such as those described in *Research Disclosure,* Vol. 176, December 1978, Item 17643 and *Research Disclosure,* Vol. 225, January 1983, Item 22534, the disclosures of which are hereby incorporated by reference in their entirety, are useful in preparing photographic elements in accordance with this invention. Generally, the photographic element is prepared by coating the support with one or more layers comprising a dispersion of silver halide crystals in an aqueous solution of gelatin, and optionally, one or more subbing layers, etc. The coating process is generally carried out on a continuously operating machine wherein a single layer or a plurality of layers are applied to the support. For multilayer elements, layers are generally coated simultaneously on the support as described in U.S. Pat. No. 2,761,791, and U.S. Pat. No. 3,508,947.

The process in accordance with this invention requires two corona discharge treatments at different stages in the process for the formation of the light-sensitive photographic paper. The first shortly follows the completion of the coating of the polyolefin layer onto the base paper stock support. This treatment is prior in time to the storage of the polyolefin coated paper which storage occurs after the paper is rolled in a spiral roll upon itself at completion of the coating operation. This storage is necessitated by the logistics involved in the scheduling of the paper for sensitization whether that be because of the sensitizing being conducted at a different time or that the sensitization occurs at a different location or whatever the reason may be. Subsequent to the initial corona discharge treatment the paper is rolled upon itself in customary fashion and stored for periods of time anywhere from weeks to months to years. When the polyolefin coated paper is to be sensitized it is first subjected to the second corona discharge treatment in order to render the surface more suitable for the silver halide emulsion layers or the subbing layers to adhere to the polyolefin surface. In many applications subbing layers commonly and well known in the photographic art are applied initially and then the emulsion layer. These various layers may all be applied in a simultaneous fashion by utilizing casting techniques widely known in the art.

The two corona discharge treatments to the polyolefin surface are supplied by well known power sources. The spark gap type power source for the corona has current supplied to the electrodes by a spark gap excited oscillator in a well-known manner. Variation in fundamental frequency of the corona is obtained by changing the primary power frequency of the oscillator. A high voltage corona is desirable, e.g., 25,000 to 50,000 volts or higher. Voltages of this range are adequate for corona activation of polymers at web speeds of about 100 to 1,000 feet per minute or higher. Voltage is varied by spacing the spark gaps and by varying the primary voltage to the oscillator.

Continuous wave corona is advantageously used. Continuous wave corona is obtained by using as the power source a motor-generator set whereby a sinesoidal waveform generator with a fixed number of poles is driven by a variable speed motor, giving a variable frequency sine wave output. Variation in frequency of the continuous wave corona of from about 1,000 to 10,000 or higher cycles per second is obtained by varying the speed of the driving motor. Voltage of the continuous wave corona which is stepped up in value by a multitap transformer and varied by field control can vary from about 5,000 volts to 30,000 volts or higher at web speeds of about 100 to 1,000 f.p.m.

The corona can be applied to the polymeric surface, for example, by means of several metal electrodes positioned close to the polymeric surface at a point where the polymeric surface is passing over a grounded metal roll coated with a dielectric material such as a linear polyester. Similarly, a metal roller may be used to support the web with the other electrode already being in planatary disposition equidistant from the surface of the metal roller and each being coated with a dielectric, at least on the surface nearest the metal roller. As mentioned above, the spacing of the electrodes to the polymer surface and ground roll should be adequate to produce the corona at the voltage used and yet allow for free passage of polymeric sheet through the activating zone. Corona supplied by DC current, or a combination of AC superimposed on DC can be used. However, there appears to be no advantage in using DC corona and, in fact, AC is preferred since the continuous wave AC corona requires much less power and is, thus, considerably cheaper to use.

The invention will be further illustrated by the following examples:

EXAMPLE 1

The surface of a high quality paper base material having a thickness of about 175 mm and a basis weight of about 180 g/m$^2$ was coated with a clear polyethylene at a coverage of 29 g/m$^2$ and the opposite surface of the paper was coated with a polyethylene coating containing 12.5 percent by weight of titanium dioxide and fluorescent optical brightener sold by Celanese-Hoechst under the trade designation Hostalux. This optical brightener was a mixture of bis(benzoxazolyl)stilbenes more specifically defined in U.S. Pat. No. 4,794,071 which is incorporated herein by reference. The optical brightener was present in the polyethylene coating on the face side of the paper support in amounts of 0.05 percent by weight (Sample A) and 0.10 percent by weight (Sample B).

The Samples were subjected to corona discharge treatment in a device including an interrupter type induction coil with its output wired to two 3 by 3-inch metal plates separated by a 12 by 12-inch, ⅛-inch thick plate glass, with a ¼-inch air space between one of the plates and the glass. Treatment of the sample consisted of placing the sample faced-up in the air space and lying on the glass plate and operating the induction coil for a number of seconds. Upon operation of the induction coil from either a 6- or 9-volt supply, a blue haze filled the air space between the plates. The 9-volt supply, when not attached to the plate, is capable of producing a 4-inch long spark gap. An electric timer was used to achieve predetermined treatment times.

The treatment of Samples A and B were for 2 and 4 seconds at 6 volts, 4 seconds at 9 volts, five 2-second bursts at 6 volts, and two 10-second bursts at 6 volts. All of the Samples and several untreated controls of the same two compositions, were placed in an oven at 166° F., side-by-side, treatment-side up for 15 hours. No distinction between the treated samples and the controls could be visually determined under both white light and under ultraviolet light after this incubation. However, when the surface of the samples was rubbed with a fresh filter paper or with a finger, a bright yellow streak was visible on the filter paper and on the finger from all of the control samples. None of the treated samples regardless of the time, voltage or percent of optical brightener included in the polyethylene layer exhibited any evidence of exudation from the polyethylene layer. The control containing 0.1 percent by weight of optical brightener produced much brighter intensities indicating that the rate and degree of exudation was higher with regard to that sample.

EXAMPLE 2

A high quality base material as in Example 1 was coated with a polyethylene coating on the face-side with the same coating composition, however, it was coated in a coverage of approximately 2.5 times that of Example 1. The polyethylene coating contains 0.05 weight percent of the same optical brightener as in Example 1. This sample was treated with corona discharge utilizing the same device in Example 1 at 9 volts input for 2, 4, and 8 seconds, respectively, however, the polarity of the discharge was changed. The treated samples together with control samples were placed in an oven at 166° F. for 24 hours. The controls exhibited severe exudation when rubbed in accordance with the procedures outlined in Example 1 and viewed under ultraviolet light. The samples treated in accordance with this invention did not show any exudation.

EXAMPLE 3

In this example, the samples were corona discharge treated with a commercial Tesla unit which provided unpolarized corona discharge, the unit being operated at 147 volts and 11.2 amps. The Tesla unit was mounted on a development extrusion apparatus utilized to coat rolled paper with a polyethylene layer in a 12 inch wide roll. This unit provides a corona discharge treatment zone approximately 8 inches long as measured in the direction of movement of the coated paper.

Paper samples having the same description as in Example 1 were prepared with the exception that the following amounts of optical brightener were utilized in various samples:

| Sample | Percent By Weight | Optical Brightener |
|---|---|---|
| A | 0.05 | Eastobrite ® OB-1 |
| B | 0.10 | Eastobrite OB-1 |
| C | 0.05 | Hostalux |
| D | 0.10 | Hostalux |

Eastobrite OB-1 2,2'-(1,2-ethenediyldi-4,1-phenylene)bisbenzoxazole, is an optical brightener sold by Eastman Chemical Products, Inc., Kingsport, Tenn.

The coated paper was moved through the Tesla unit at approximately 100 ft/min.

Each of the samples A through D were subjected to corona discharge by the Tesla corona discharge unit described above under the conditions included. All of the samples including controls which were not subjected to the corona discharge treatment were incubated for 24 hours at 166° F. and then evaluated under ultraviolet in the same manner as that described in Example 1. The untreated controls A, B, and D exhibited severe exudation. The sample C control exhibited only mild exudation after incubation. Both the control sample B and the treated sample B containing 0.10 percent Eastobrite ® OB-1, optical brightener, exhibited mild exudation without any incubation. The remainder of the corona discharge treated samples did not exhibit any exudation.

What is claimed is:

1. In the method of making a light-sensitive photographic paper comprising the steps of coating a paper support with a polyolefin polymer containing an optical brightening agent, rolling the polyolefin coated support and storing the paper roll, unrolling the stored support, corona discharge treating the polyolefin surface and applying at least one light sensitive emulsion on the polyolefin surface, the improvement which comprises after coating the polyolefin layer on the paper support and prior to the rolling step subjecting the polyolefin surface to a corona discharge to inhibit the optical brightening agent from exuding from the polyolefin layer.

2. The method of claim 1 wherein the polyolefin polymer is polyethylene.

3. The method of claim 1 wherein the polyolefin polymer contains a white pigment.

4. The method of claim 3 wherein the white pigment is titanium dioxide.

* * * * *